US005820360A

United States Patent [19]

Callahan

[11] Patent Number: 5,820,360

[45] Date of Patent: Oct. 13, 1998

[54] CANDLE SNUFFER

[76] Inventor: Debra Callahan, 1436 Wet Gray, #938, Houston, Tex. 77019

[21] Appl. No.: 839,972

[22] Filed: Apr. 24, 1997

[51] Int. Cl.[6] ..... F23Q 25/00

[52] U.S. Cl. ..... 431/144; D26/23

[58] Field of Search ..... D26/23; 431/144

[56] References Cited

U.S. PATENT DOCUMENTS

| | | |
|---|---|---|
| 1,740,623 | 12/1929 | Payne . |
| 1,822,652 | 9/1931 | Gluckert . |
| 3,775,037 | 11/1973 | Sande . |
| 3,985,492 | 10/1976 | Nunemaker . |
| 4,497,374 | 2/1985 | Miller . |
| 5,282,737 | 2/1994 | Ray . |

OTHER PUBLICATIONS

Arthur H. Hayward, "Colonial and Early American Lighting", copyright page, pp. 101–103. Specific Date Unknown.
1996 Chambers catalog p. 5, Item E, Specific Date Unknown.
1996 Bloomingdales catalog p. 55, Specific Date Unknown.
1996 Bloomingdales by Mail catalog, Item A, Specific Date Unknown.
1996 Illuminations Holiday catalog p. 19, Item B, Specific Date Unknown.
1996 Illuminations Holiday catalog p. 13, Item J, Specific Date Unknown.
1996 Tiffany's catalog pp. 21 and 34, Items A and B, Specific Date Unknown.
1996 Museum of Modern Art catalog pp. 42–43, Item A, Specific Date Unknown.
Pier 1 Imports purchase prior to Apr. 24, 1997.
Miscellaneous antique store purchase prior to Apr. 24, 1997.
Pier 1 Imports purchase prior to Apr. 24, 1997.
Two company's purchase prior to Apr. 24, 1997.
Superlatives purchase prior to Apr. 24, 1997.
Seagull of Nova Scotia purchase prior to Apr. 24, 1997.

*Primary Examiner*—Carroll B. Dority
*Attorney, Agent, or Firm*—Gottlieb, Rackman & Reisman, P.C.

[57] ABSTRACT

An improved candle snuffer is provided. The candle snuffer comprises a handle, a flame extinguisher extending from the handle and a support assembly for keeping the extinguisher from touching a table or other surface upon which the snuffer is laid to rest. This structure is provided for both a candle snuffer for use with exposed candles and candle snuffers for use with candles that are within some type of decorative or wind protective container, for example, a hurricane lantern.

19 Claims, 6 Drawing Sheets

CANDLE SNUFFER

BACKGROUND OF THE INVENTION

This invention relates to the field of candle snuffers, and more particularly, to a new and improved candle snuffer which allows for display of the snuffer on a table, or other such surface, without allowing the extinguisher element of the snuffer to touch the table or surface.

The use of candles for light and decoration is extraordinarily old. It is also old in the art that the flames of the candles eventually need to be put out so as to preserve the candle for later use or to prevent accidental fire by simply leaving the candle lit and walking away. There are essentially five known methods of extinguishing a candle flame. These methods include (1) blowing out the flame, either physically or with a blowing device, (2) cutting off the wick of a candle just below the base of the flame, (3) pinching the flame between wetted surfaces such as fingers or flat-faced tongs, (4) placing fork tines around the wick at the base of the flame, or (5) smothering the flame by capping or covering the wick.

All of the above five prior art methods of extinguishing candle flames have the same important deficiency: the possibility that the method used will cause hot wax and/or soot to come in contact with the table or other surface on which the candle is resting, or onto the device used to snuff the flame, and thereafter, onto the table. Each of the above methods and its associated deficiencies will now be discussed.

The method of blowing out the candle flame can easily blow hot wax, which has puddled on top of the candle at the base of the wick, onto the table or other surface on which the candle is resting. An additional deficiency with blowing candles out is that sometimes the candle is not within blowing reach.

Cutting the wick of the candle is one of the oldest snuffer designs. In this case, scissors with one broad blade and a lip were used to cut and catch the burnt wick; they were not used to actually extinguish the flame. Even though today's candle wicks are entirely consumed as they burn, the cutting method is still available, since one could cut the burning wick at the base of the flame. The deficiency here is that the cutting device would invariably touch the pooled wax at the top of the candle and below the flame. In this manner, the cutting device would accumulate hot wax and possibly soot that, without a separate cradling device, would damage the table (table linens) or other surface on which the cutting device is ultimately laid to rest.

Pinching devices have the same problem of scooping puddled wax off of the top of the candle and onto the table or other surface, as well as the problem of accumulating wax and soot on the pinching device which without some type of cradle would cause transfer of the wax and soot onto the table or other surface.

The fork tine method requires even more personal dexterity and balance than the above three methods and therefore wax accumulation on the tines is almost guaranteed to be a problem when the item is laid to rest.

Smothering candle flames is the most commonly used method for snuffing candles today. It is also the method that creates the most soot and thus the greatest need for protecting tables and other surfaces when the smothering device is laid to rest. All such devices observed to-date mount the extinguisher, typically cone shaped, at approximately 90° to a shaft-like handle. When laid to rest, the cone opening is designed to touch any resting surface. Even when laid on its side, the edge of the cone opening still touches the resting surface. The inside of the cone and the edge of the cone accumulate wax and soot, even if the extinguisher is wiped-out immediately after using. This accumulated wax and soot is potentially damaging to the table or other resting surface.

Accordingly, it would be desirable to provide an improved candle snuffer that provides for use of the smothering method of extinguishing a candle flame, while further allowing for display or resting of the snuffer on a table or other surface without the extinguisher touching the table or other surface, so as to prevent transferring damaging soot and wax from the extinguisher to the table or other surface.

SUMMARY OF THE INVENTION

In accordance with the invention, an improved candle snuffer is provided. The candle snuffer comprises a handle, a flame extinguisher extending from the handle and a support assembly for keeping the extinguisher from touching a table or other surface upon which the snuffer is laid to rest. This structure is provided for both a candle snuffer for use with exposed candles and candle snuffers for use with candles that are within some type of decorative or wind protective container, for example, a hurricane lantern.

Accordingly, it is an object of the invention to provide an improved candle snuffer.

Still another object of the invention is to provide an improved candle snuffer for use with both exposed candles and candles within protective containers.

Yet another object of the invention is to provide an improved candle snuffer having a support assembly for keeping the extinguisher of the snuffer from touching the table or other surface upon which the snuffer is laid to rest.

Other objects of the invention will in part be obvious and will in part be apparent from the following description.

The invention accordingly comprises an assembly possessing the features, properties and the relation of components which will be exemplified in the product hereinafter described, and the scope of the invention will be indicated in the claims.

BRIEF DESCRIPTION OF THE DRAWINGS

For a fuller understanding of the invention, reference is made to the following description taken in connection with the accompanying drawings, in which.

DETAILED DESCRIPTION OF THE PREFERRED EMBODIMENT

As discussed in the Background of the Invention section, standard, prior art candle snuffers have never been designed to protect the table or other surface upon which the snuffer is ultimately laid to rest (displayed) after extinguishing a candle flame, from the built-up wax and soot which accumulates on the extinguisher of the snuffer. Such a prior art candle snuffer is shown at 10, in FIGS. 1 and 2.

Figure 1:
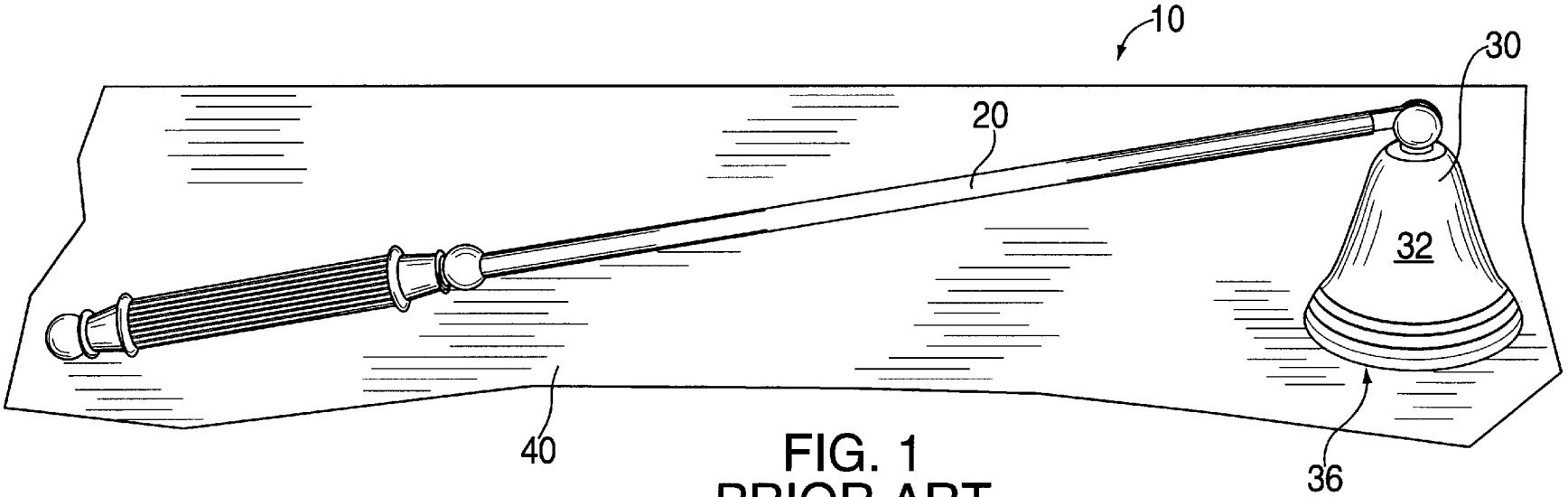
FIG. 1 PRIOR ART
FIG. 1 is a perspective view of a prior art candle snuffer resting upon a table or other surface.
Figure 2:
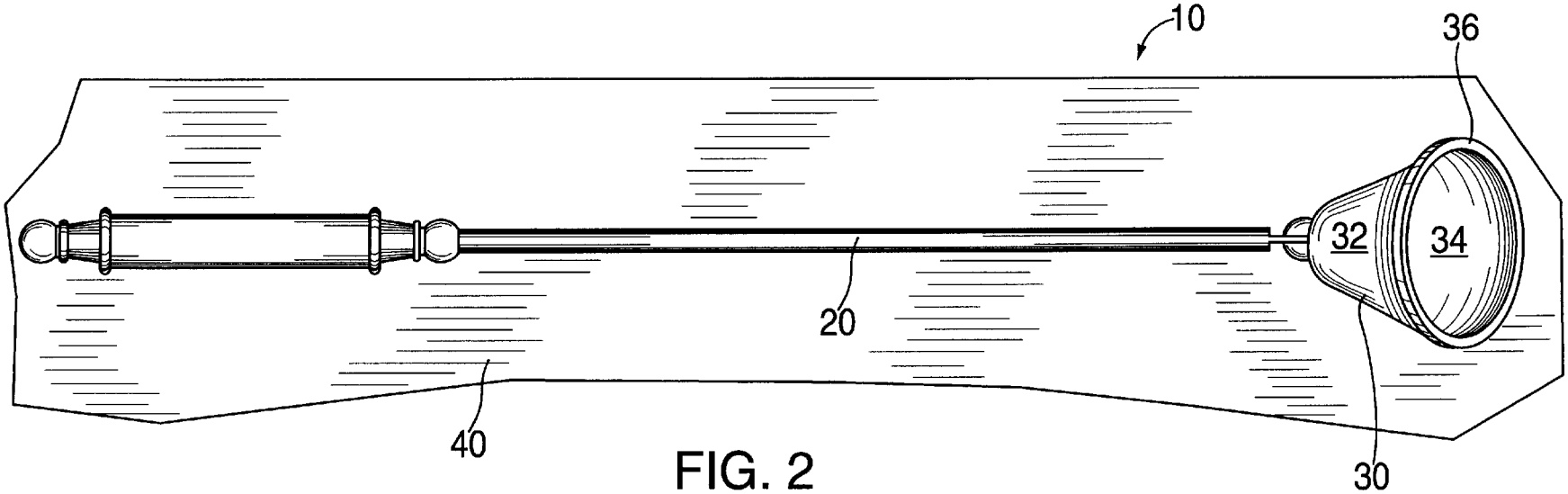
FIG. 2 PRIOR ART
FIG. 2 is a perspective view of the prior art snuffer of FIG. 1, resting on the table or other surface in a different manner.

As shown in FIGS. 1 and 2, candle snuffer 10 has a handle 20 and a substantially conically shaped extinguisher 30. Extinguisher 30 has an outside surface 32, an inside surface 34 and an edge (lip) 36 which defines the opening into the interior of extinguisher 30.

As is further shown in FIGS. 1 and 2, prior art snuffer 10 is laid to rest upon (displayed upon) a table or other surface 40. In this way, any soot and/or wax which has accumulated on inside surface 34, outside surface 32 or around edge 36 of extinguisher 30 will come into contact with table or other surface 40 when snuffer 10 is laid to rest (displayed) after extinguishing a candle flame. It is the transfer of the soot and/or wax from extinguisher 30 of snuffer 10 which the present invention overcomes.

Figure 3:
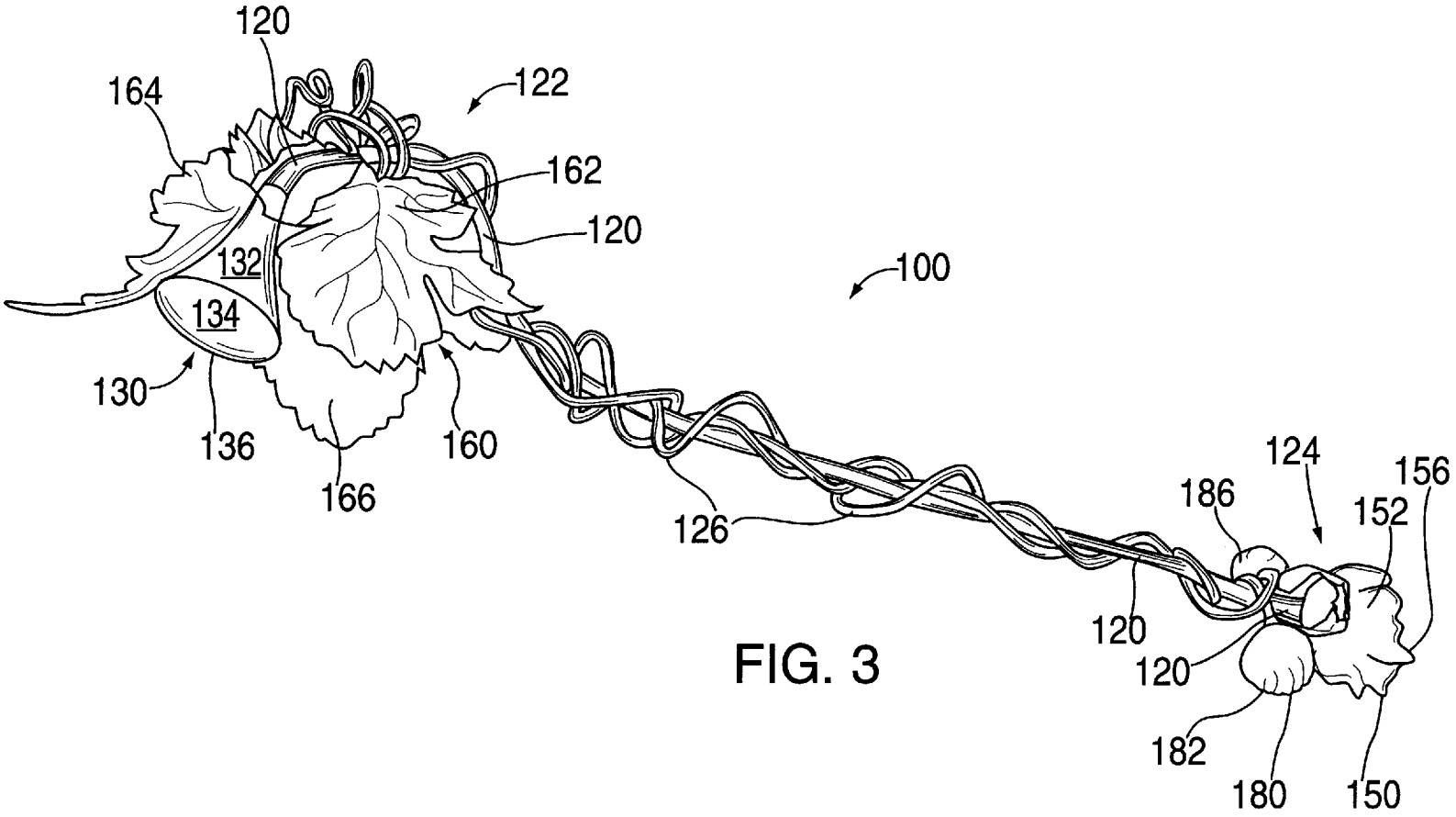
FIG. 3 is a perspective view of the candle snuffer of the present invention.
Figure 4:
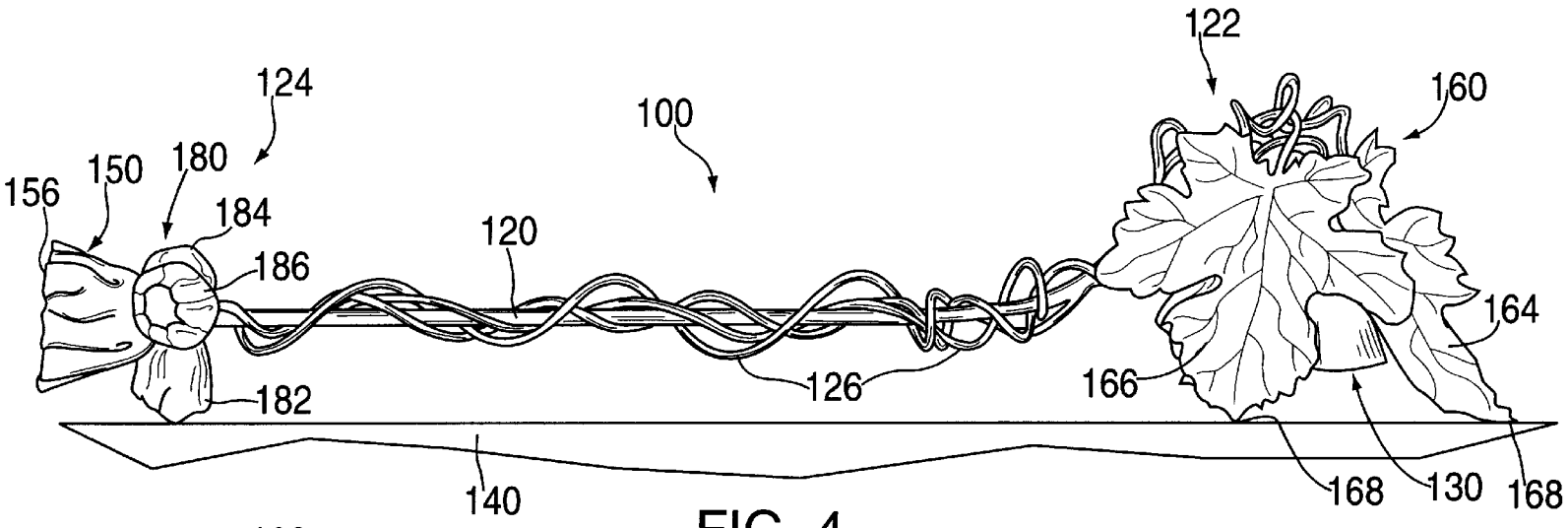
FIG. 4 is a side elevational view of the candle snuffer of FIG. 3 resting upon a table or other surface and showing the extinguishers above the surface.
Figure 5:
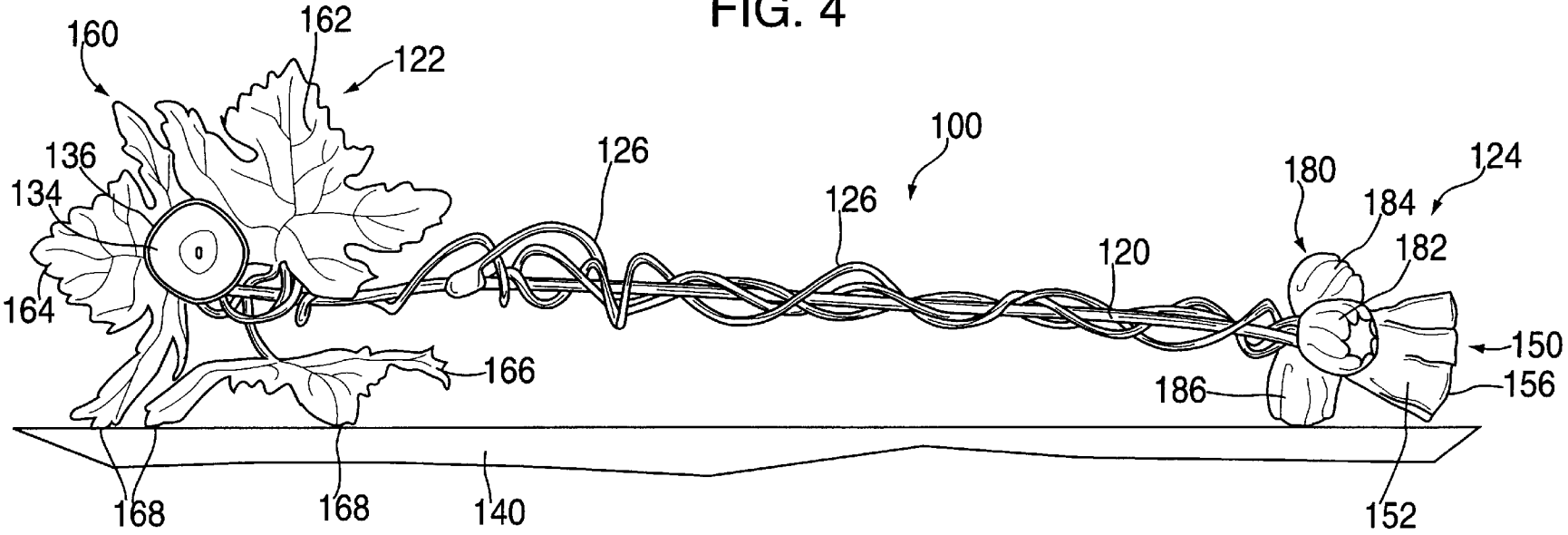
FIG. 5 is a side elevational view of the candle snuffer of FIG. 3 shown resting on a table or other surface in an orientation different from that shown in FIG. 4.

Turning now to a discussion of FIGS. 3–5, an improved candle snuffer made in accordance with the invention and generally designated at 100 is shown. Candle snuffer 100 comprises a handle 120, flame extinguishers 130 and 150, and support assemblies 160 and 180.

Candle snuffer 100 shows a highly decorative handle 120 having decorative vine elements 126 intertwined therearound. This being one particular embodiment of the invention, it is understood that any type of handle configuration, having or not having design elements thereon or therearound, is anticipated by the invention.

Extending from a first end 122 of handle 120 is extinguisher 130. Snuffer 100, as seen in the figures, is preferably made of some type of metal or metal alloy. As such, handle 120 and extinguisher 130 can be uniformly cast. However, the preferred embodiment is for extinguisher 130 to be formed independently into substantially conical shape, and then to be welded or soldered onto first end 122 of handle 120. The invention anticipates the use of different materials to make snuffer 100, and accordingly, different manners of attaching extinguisher 130 to handle 120 are also anticipated.

Extinguisher 130, as previously stated, is substantially conical in configuration. In fact, the interior volume of extinguisher 130 has been designed to be small, so as to allow for quick extinguishing of a candle flame by cutting off oxygen to the flame. Prior art candle snuffers did not focus upon the interior volume size of their extinguisher elements, and as such, these volumes have historically been larger than necessary. To the extent that the volume within the prior art snuffer extinguishers is large, the amount of oxygen contained therein is also large, thereby allowing for longer burning of the candle while trying to extinguish the candle flame. The longer the candle flame stays lit, the more soot which is built up in, on and around the extinguisher. Accordingly, the use of a volumetrically small conical inside of extinguisher 130 restricts the amount of oxygen in extinguisher 130, thereby allowing for quick cutoff of oxygen to the candle flame and faster extinguishing of the same.

Even with the above inventive character of snuffer 100, wax and soot will be built up on, in and around extinguisher 130 during snuffing of a candle flame. In particular, the wax and/or soot build up will occur on outside surface 132, inside surface 134 and edge 136 of extinguisher 130. Without the existence of support assembly 160 (to be discussed immediately below), when snuffer 100 is laid to rest (displayed) upon a table or other surface 140 (see FIGS. 4 and 5), extinguisher 130 would touch table 140 thereby transferring soot and wax to table 140.

Turning now to a discussion of support assembly 160, it is seen in the embodiment shown in FIGS. 3–5 that support assembly 160 comprises three support elements 162, 164 and 166. Support elements 162, 164 and 166 are in the shape and design of leaves. The shape and design of support elements 162, 164 and 166 go along for this particular embodiment with the scheme of handle 120 and decorative elements 126, and is not meant to be limiting.

Essentially, support elements 162, 164 and 166 extend from different branches of vine elements 126 of handle 120, so as to extend around extinguisher 130 and beyond edge 136. When snuffer 100 is laid upon table 140 in either the position shown in FIG. 4 or the position shown in FIG. 5, the positioning of support elements 162, 164 and 166 are important, since they support snuffer 100 at first end 122 in such a way that extinguisher 130 does not touch table 140. Ultimately, however, the exact manner of construction of support assembly 160 around extinguisher 130 is not limited to the manner shown in the figures, but can encompass many different types of constructions, so as to achieve the ultimate goal of supporting extinguisher 130 above table 140 so as not to transfer soot and/or wax onto table 140.

As seen in FIG. 5, various contact points 168 are found to exist on support elements 162, 164 and 166, when snuffer 100 is laid in different positions.

Turning now to a discussion of extinguisher 150 and support assembly 180, found at second end 124 of handle 120 (FIGS. 3–5), it is to be understood that although the manner of construction is slightly different than the construction shown for the assembly at first end 122 of handle 120, the purpose of the invention is the same; to provide a candle snuffer which has an extinguisher supported over a table or other surface after the snuffer is used and the snuffer is laid to rest (displayed) on the table.

With this in mind, now addressing our attention to extinguisher 150 and support assembly 180, as seen in FIGS. 3–5, it is seen that extinguisher 150 has outside surface 152, edge 156 and inside surface 154 (not shown). It is also seen that support assembly 180 has support elements 182, 184 and 186. These support elements do not extend around extinguisher 150, or extend past edge 156, but instead extend around second end 124 of handle 120 such that when snuffer 100 is laid to rest on table 140, no part of extinguisher 150 will touch table 140, and instead some one part or different parts of elements 182, 184 and/or 186 will touch table 140. In this manner, extinguisher 150 is kept above table 140 and the soot and/or wax built up on extinguisher 150 does not transfer to table 140.

Figure 6:
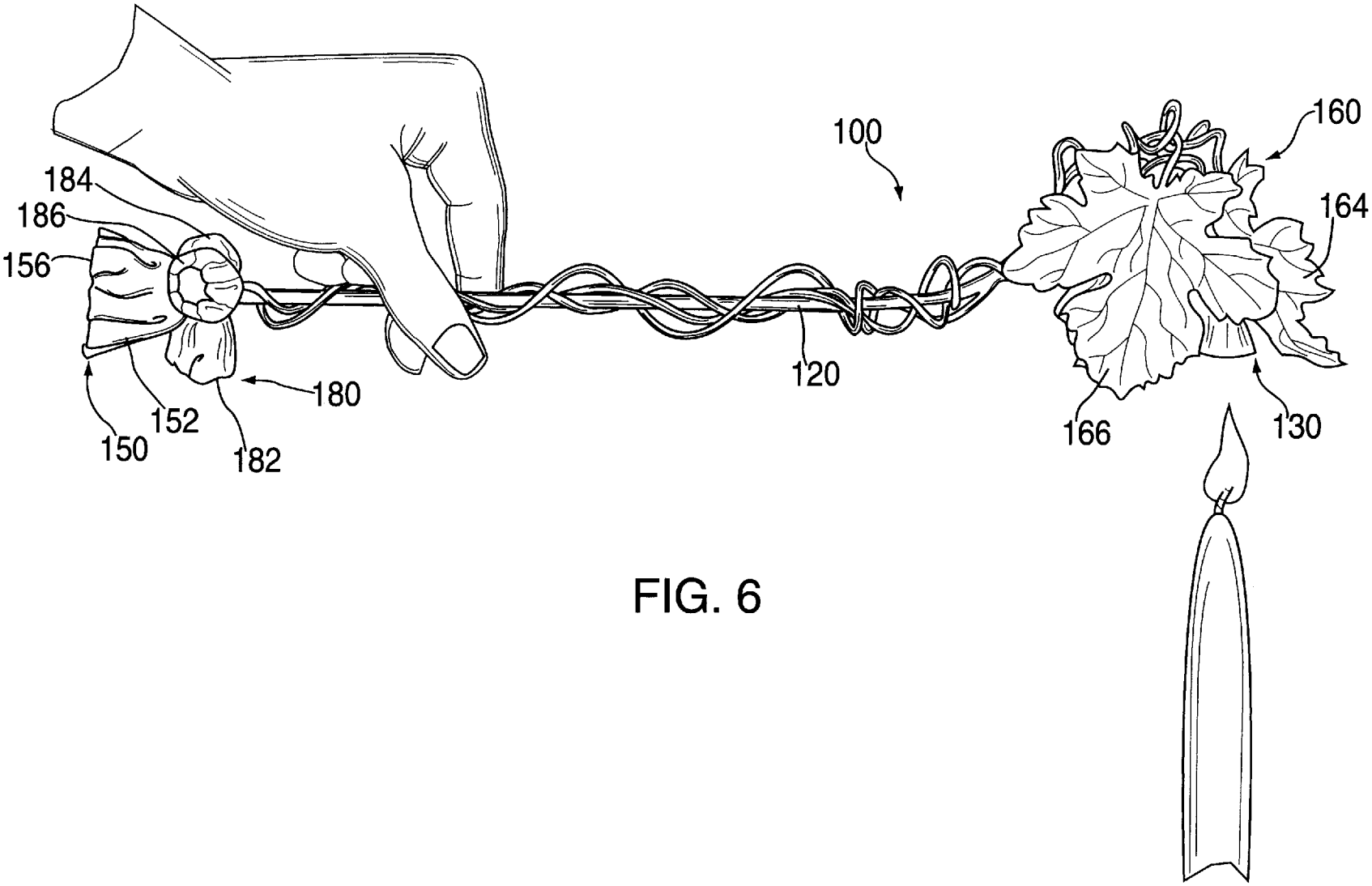
FIG. 6 is a side elevational view showing use of the candle snuffer of FIG. 3 in extinguishing an exposed candle flame.
Figure 7:
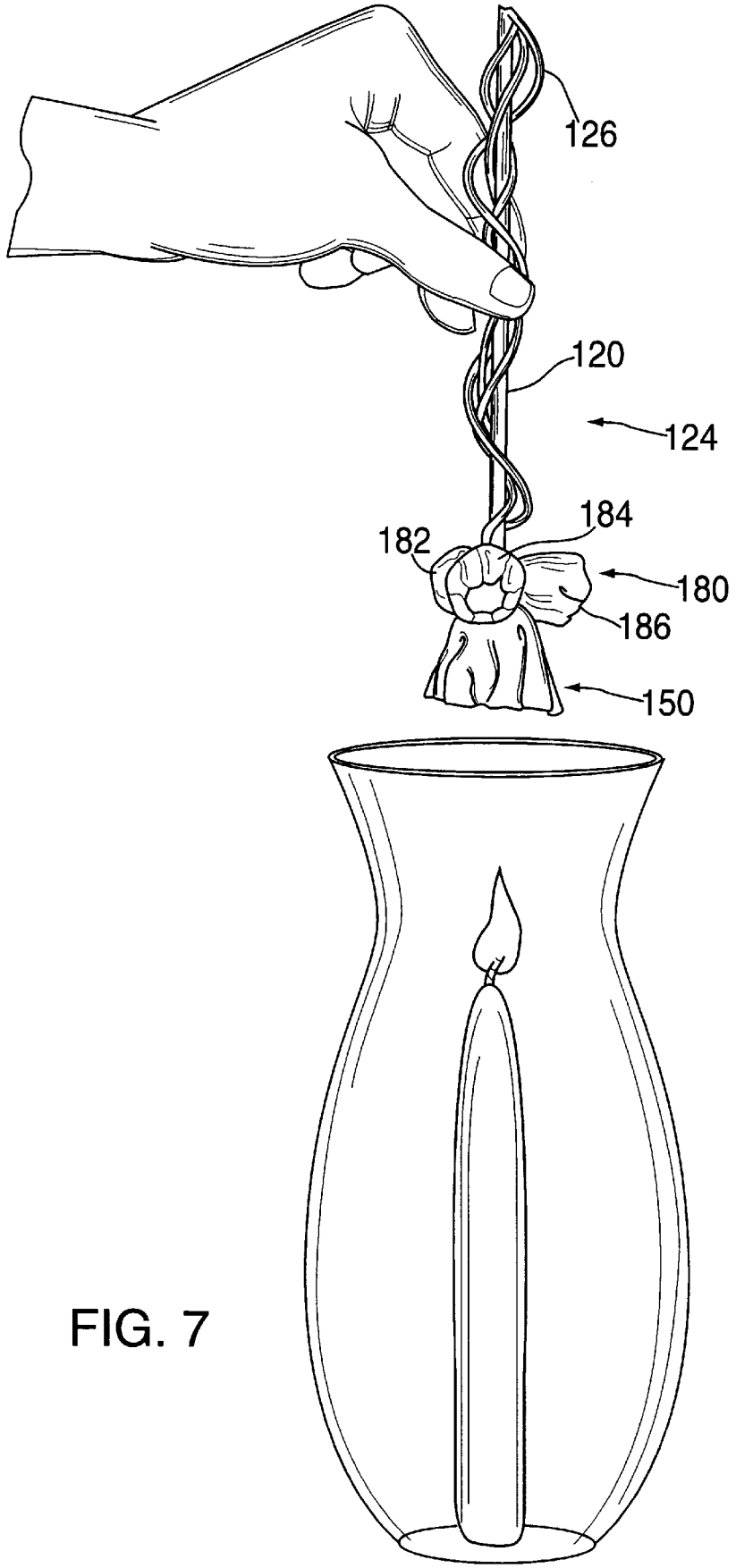
FIG. 7 is a side elevational view of the candle snuffer of FIG. 3 in use to extinguish a candle flame within a protective container.

How the inventive candle snuffer 100 is used is shown in FIGS. 6 and 7. FIG. 6 shows use of snuffer 100 in extinguishing a free standing, unincumbered candle, while FIG. 7 shows use of snuffer 100 in extinguishing a candle within a container or hurricane lantern. It is in viewing these two figures where one can appreciate the purpose of having extinguishers 130 and 150 on opposite ends of handle 120.

It will thus be seen that the objects set forth above, among those made apparent from the preceding description, are efficiency attained and, since certain changes may be made in the above constructions without departing from the spirit and scope of the invention, it is intended that all matter contained in the above description and shown in the accompanying drawings shall be interpreted as illustrative, and not in a limiting sense.

It is also to be understood that the following claims are intended to cover all of the generic and specific features of the invention herein described and all statements of the scope of the invention which, as a matter of language might be said to fall therebetween.

What is claimed is:

1. A candle snuffer for extinguishing candle flames and for display upon a substantially horizontal planar surface, comprising:

a handle;

a flame extinguisher extending from said handle; and a support assembly for keeping said extinguisher from touching said substantially horizontal planar surface.

2. A candle snuffer as recited in claim 1, said handle having first and second ends, and said flame extinguisher comprising a first flame extinguisher at said first end of said handle and a second flame extinguisher at said second end of said handle.

3. A candle snuffer as recited in claim 1, said extinguisher having a substantially conically shaped interior for receipt therein of said flame.

4. A candle snuffer as recited in claim 4, wherein a volume of space defined by said substantially conically shaped interior of said extinguisher is small for quick cut off of oxygen to said flame.

5. A candle snuffer as recited in claim 3, said extinguisher further having a first end attached to said handle, and a second end defining an opening to said substantially conically shaped interior of said extinguisher.

6. A candle snuffer as recited in claim 5, wherein the wax and soot collected in said interior of said extinguisher and around said second end of said extinguisher are prevented from touching said substantially horizontal surface after extinguishing said flame and during display of said snuffer, by said support assembly.

7. A candle snuffer as recited in claim 6, wherein said opening of said extinguisher is substantially in a plane which is substantially parallel to said substantially horizontal planar surface when said snuffer is displayed.

8. A candle snuffer as recited in claim 7, said support assembly extends from said handle around said extinguisher and past said second end of said extinguisher, so that said support assembly touches said substantially horizontal planar surface in at least two locations and said second end of said extinguisher is thereby maintained in an elevated position above said substantially horizontal planar surface.

9. A candle snuffer as recited in claim 6, wherein said opening of said extinguisher lies substantially in a plane which crosses the plane of said substantially horizontal planar surface when said snuffer is displayed.

10. A candle snuffer as recited in claim 9, said support assembly extends around said handle proximate said first end of said extinguisher, so that said support assembly touches said substantially horizontal planar surface in at least one location and said second end of said extinguisher is thereby maintained in an elevated position above said substantially horizontal planar surface.

11. A candle snuffer, comprising:

a handle having first and second ends;

a first snuffer assembly at said first end of said handle; and a second snuffer assembly at said second end of said handle;

said first and second snuffer assemblies each comprising:

a flame extinguisher extending from said handle; and a support assembly for keeping said extinguisher from touching a substantially horizontal planar surface used for displaying said candle snuffer.

12. A candle snuffer as recited in claim 11, said extinguisher having a substantially conically shaped interior for receipt therein of said flame.

13. A candle snuffer as recited in claim 12, wherein a volume of space defined by said substantially conically shaped interior of said extinguisher is small for quick cut off of oxygen to said flame.

14. A candle snuffer as recited in claim 12, said extinguisher further having a first end attached to said handle, and a second end defining an opening to said substantially conically shaped interior of said extinguisher.

15. A candle snuffer as recited in claim 14, wherein the wax and soot collected in said interior of said extinguisher and around said second end of said extinguisher are prevented from touching said substantially horizontal surface after extinguishing said flame and during display of said snuffer, by said support assembly.

16. A candle snuffer as recited in claim 15, wherein said opening of said extinguisher is substantially in a plane which is substantially parallel to said substantially horizontal planar surface when said snuffer is displayed.

17. A candle snuffer as recited in claim 16, said support assembly extends from said handle around said extinguisher and past said second end of said extinguisher, so that said support assembly touches said substantially horizontal planar surface in at least two locations and said second end of said extinguisher is thereby maintained in an elevated position above said substantially horizontal planar surface.

18. A candle snuffer as recited in claim 15, wherein said opening of said extinguisher lies substantially in a plane which crosses the plane of said substantially horizontal planar surface when said snuffer is displayed.

19. A candle snuffer as recited in claim 18, said support assembly extends around said handle proximate said first end of said extinguisher, so that said support assembly touches said substantially horizontal planar surface in at least one location and said second end of said extinguisher is thereby maintained in an elevated position above said substantially horizontal planar surface.

* * * * *